United States Patent [19]

Markson

[11] Patent Number: 4,823,406

[45] Date of Patent: Apr. 25, 1989

[54] METHOD OF MANUFACTURING STOCKING CAP AND RESULTANT ARTICLE

[75] Inventor: Theodore Markson, Woodmere, N.Y.

[73] Assignee: Paris Accessories, Inc., New York, N.Y.

[21] Appl. No.: 227,077

[22] Filed: Aug. 1, 1988

[51] Int. Cl.[4] ..... A42B 1/04

[52] U.S. Cl. ..... 2/201

[58] Field of Search ..... 2/171, 171.5, 171.6, 2/171.8, 175, 190, 192, 195, 196, 198, 201, 203; 66/170, 171, 169 R

[56] References Cited

U.S. PATENT DOCUMENTS

| | | | |
|---|---|---|---|
| 344,368 | 6/1886 | Freschl | 2/201 |
| 1,606,798 | 11/1926 | Karger | 2/201 X |
| 3,157,887 | 11/1964 | Rothstein | 2/201 X |
| 3,271,781 | 9/1966 | Sontag et al. | 02/202 |
| 4,176,409 | 12/1979 | Everitt | 2/202 X |

*Primary Examiner*—Werner H. Schroeder
*Assistant Examiner*—Sara M. Current
*Attorney, Agent, or Firm*—Arthur B. Colvin

[57] ABSTRACT

A method of forming a stocking cap is disclosed which includes the steps of providing a tubular sleeve or body of knitted fabric, everting the sleeve to bring the raw edges of the sleeve into registry, encompassing the everted sleeve within a liner which is shorter than the everted sleeve to bring the raw edges at one end of the liner into registry with the raw edges of the sleeve, attaching the raw edges of the sleeve and liner by a pair of transversely intersecting stitch lines, stitching the other edge of the liner to the sleeve about a circumferential stitch line, and thereafter everting the resultant sub-assembly to provide a stocking cap wherein the liner is disposed interiorly, and no raw edges of the sleeve or liner remain exposed. The disclosure further relates to a stocking cap manufactured in accordance with the noted method.

5 Claims, 3 Drawing Sheets

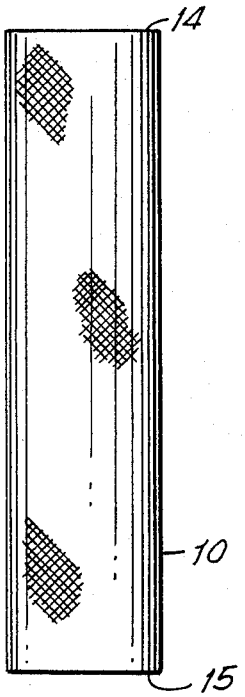
FIG. 1
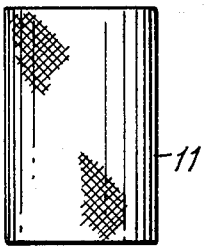
FIG. 2
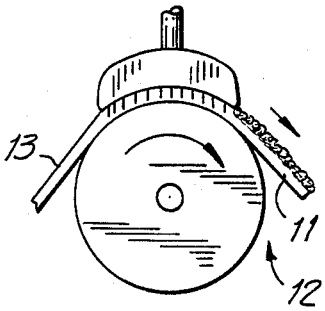
FIG. 3
FIG. 4
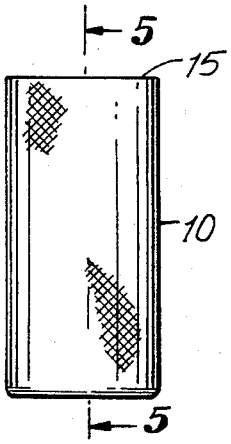
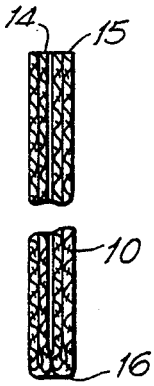
FIG. 5

METHOD OF MANUFACTURING STOCKING CAP AND RESULTANT ARTICLE

BACKGROUND OF THE INVENTION

1. Field of the Invention

The present invention is in the field of stocking caps and relates more particularly to improvements in the method of manufacturing stocking caps and to the resultant article.

2. Prior Art

Conventionally, stocking caps are manufactured by providing a length of tubular knitted material everting the fabric so as to bring the raw edges of the tubular length into registry, and thereafter forming a first overlock seam joing the raw edges. The partially formed cap is thereafter rotated through 90° g and a second overlock seam is formed across the raw edges. Thereupon, the partially formed cap is again everted to bring the seams within the inside of the tubular configuration to define the top or peak of the cap. The edge of the tubular structure remote from the seamed end may thereafter be folded upwardly to define a brim, and if desired, tack stitches may be formed through the four thickness of material to retain the brim in the upwardly folded condition.

Stocking caps of the type described are not particularly warm since protection is afforded merely by a doubled layer of knitted material which typically is a loosely knitted material to provide the desired elasticity to render the hat adaptable to a wide variety of head sizes. Also, knitted materials having elasticity to function in the desired manner generally present a rough surface which may chafe the wearer.

Representative constructions and methods of manufacturing stocking caps are disclosed in the following U.S. Pats. Nos. 975,582; 991,777; 1,486,980; 1,502,160; 1,562,838; 1,606,798; 1,710,188; 1,813,861; 2,038,398; 2,069,020; 3,157,887; 3,340,542; 3,626,724; 4,468,817.

While the above cited references disclose stocking caps of various constructions and modes of manufacture, none of the noted patents are considered to disclose a stocking cap and method of making the same wherein a warming liner is integrated into the hat in such manner that the raw edges and seaming or connecting stitching is totally obscured in the finished hat.

SUMMARY OF THE INVENTION

The present invention may be summarized as directed to an improved method of manufacturing a lined stocking cap wherein all of the raw edges of the cap material and liner are obscured to provide a neat and durable finished cap.

BRIEF DESCRIPTION OF THE DRAWINGS

In order to illustrate the method of the present invention reference is made to the accompanying drawings wherein.

FIG. 1 is a plan view of a length of tubular sleeve forming the main body of the cap.

FIG. 2 is a plan view of a length of tubular liner.

FIG. 3 is a schematic view of an apparatus for brushing or napping the liner.

FIGS. 4, 6, 8, 10, 12, 13, and 14 are sequential plan views of the components of the stocking cap at progressively advanced stages of its manufacture.

FIG. 5 is a fragmentary magnified sectional view taken on the line 5,5 of FIG. 4.

DETAILED DESCRIPTION OF THE VIEWS

Figure 6:
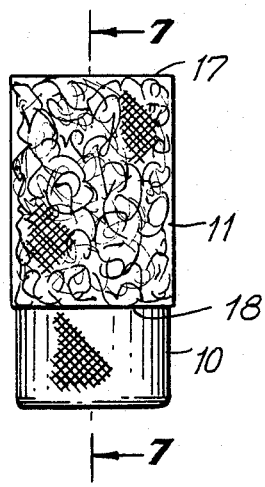
Figure 7:
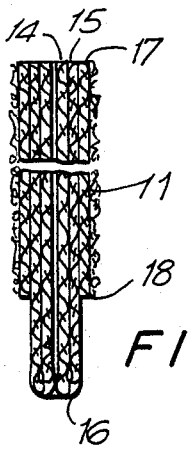
FIG. 7 is a fragmentary magnified sectional view taken on the line 7,7 of FIG. 6
Figure 8:
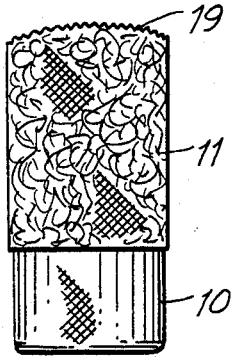
Figure 10:
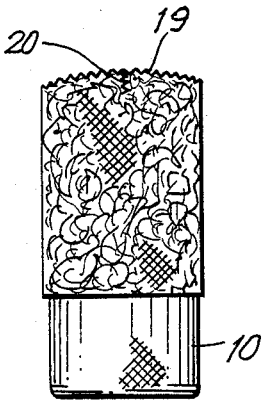

The stocking cap of the instant invention is fabricated of two components parts namely an elongate tubular knitted and stretchable fabric sleeve 10, and a tubular liner 11. The longitudinal dimension of liner 11 is somewhat less than half of the length of the body or sleeve 10.

Optionally, but preferably, the liner 11 is brushed or napped as in brushing device 12, known per se, to provide a raised and soft texture on at least the external surfaces of the tubular liner. If it is desired to provide a liner having even more body or "fluff" the liner may be everted and re-brushed in the apparatus 12.

The next step in manufacturing the stocking cap is to evert one half of the body 10 so as to bring the raw edges 14, 15 of the body into registry as shown in fig. 4. This brings the body into the configuration illustrated in FIG. 5 whereby the tube is of half of its original length and the lower most end of the tubular sleeve 10 is defined by a fold 16.

Next, the liner member 11 is sleeved over the partially everted body 10 so as to bring the upper raw edge 17 of the liner into registry with the raw edges 14, 15 of the body. In this position the lower most raw edge 18 of the liner is spaced a distance upwardly from the fold 16 defined by the lower end of the body.

Figure 9:
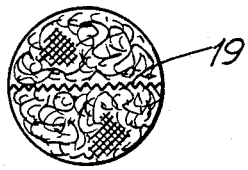
FIGS. 9 and 11 are top plan views of the partially completed stocking cap as represented by the stages illustrated in FIGS. 8 and 10 respectively.
Figure 11:
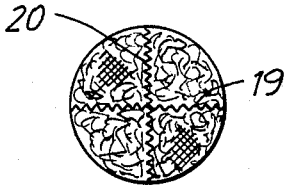

Following positioning of the liner over the body, a first transverse seam 19 is formed linking the raw edges 14, 15, and 17 respectively of the body and liner. The seam 19 is formed by an overlock stitching operation, following which the flattened tube is rotated 90°, again flattened, and a second overlock stitched seam 20 formed at right angles to the seam 19. FIGS. 9 and 11 are plan views of the spread partially assembled cap following formation of the seams 19 and 20 respectively.

Figure 12:
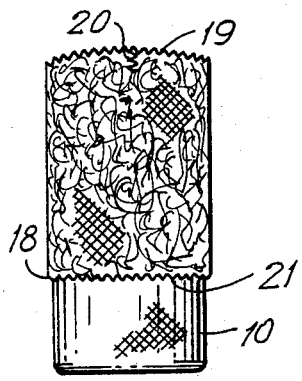
Figure 13:
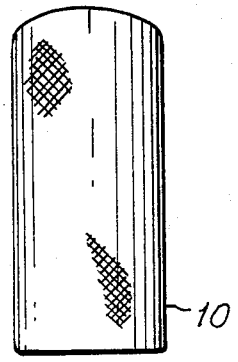

The next manufacturing step involves tucking the lower raw edge 18 of liner 11 inwardly as shown in FIG. 12 and by blind stitch line 21 forming a hem. As is known, the nature of the blind stitch is such as to permit unimpeded stretching of the tubular members connected by the circumferential cover stitch line 21.

Figure 14:
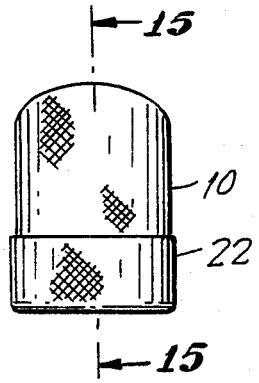
Figure 15:
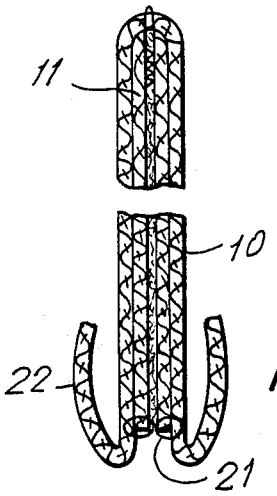
FIG. 15 is a fragmentary magnified sectional view taken on the line 15,15 of FIG. 14.

After formation of the blind stitch line 21 the tubular body is again everted from the position of FIG. 12 to the position of FIG. 12 and the construction of the hat is completed by upwardly folding the portion 22 of the body 10 into covering relation of the lower portion of the body as best seen in FIGS. 14 and 15. Optionally, the cuff 22 may be tack stitched to the adjacent portions of the body to provide a permanent cuff.

From the foregoing it will be apparent that there is provided in accordance with the present invention a method of forming a stocking cap which provides, with a minimal number of steps, an improved stocking cap having a liner wherein all of the raw edges of the liner and the body fabric are concealed in the functional or as worn condition of the cap. There is further provided a lined cap of the stocking type which is neat in appearance.

Numerous variations in details of construction and to a degree in the sequence of manufacturing steps will occur to those skilled in the art and familiarized with the instant disclosure. Accordingly, the invention is to be broadly construed within the scope of the appended claims.

I claim:

1. The method of manufacturing a hat of the stocking cap type which comprises the steps of providing a tubular sleeve having an inner and an outer face and distal edges, providing a tubular liner having first and second distal ends, the length of said liner being less than one half the length of said sleeve, everting one half of said sleeve to bring said distal edges of said sleeve into alignment, thereafter encompassing said sleeve within said liner, to position said first distal end of said liner in registry with said aligned distal edges of said sleeve, thereafter forming a first overlock stitch seam across said aligned edges and first distal end of said liner, thereafter forming a second overlock stitch seam transversely across said aligned edges and first distal end of said liner said second stitch seam intersecting said first stitch and being offset by substantially 90° attaching said second distal end of said liner to said everted sleeve by a circumferential blind stitch to define a hem and thereafter everting said sleeve and liner to dispose said outer face of said sleeve outermost.

2. The method in accordance with claim 1 wherein said second distal end of said liner is everted to be disposed between said liner and sleeve in advance of forming said cover stitch.

3. The method in accordance with claim 1 and including the step of everting portions of said sleeve remote from said distal edges of said sleeve to form a cuff.

4. The method in accordance with claim 2 and including the step of everting portions of said sleeve remote from said distal edges of said sleeve to form a cuff, and thereafter tack stitching said cuff to the adjacent portions of said cap.

5. A stocking cap formed in accordance with the method of claim 1.

* * * * *